US006241294B1

(12) United States Patent
Young et al.

(10) Patent No.: US 6,241,294 B1
(45) Date of Patent: Jun. 5, 2001

(54) MOTOR VEHICLE DOOR HANDLE ASSEMBLY

(75) Inventors: Richard T. Young, Lowell; James Dmytrow, Grand Rapids, both of MI (US)

(73) Assignee: Adac Plastics, Inc., Grand Rapids, MI (US)

( * ) Notice: Subject to any disclaimer, the term of this patent is extended or adjusted under 35 U.S.C. 154(b) by 0 days.

(21) Appl. No.: 09/366,861

(22) Filed: Aug. 4, 1999

(51) Int. Cl.[7] ..... E05B 3/00

(52) U.S. Cl. ..... 292/336.3; 292/DIG. 22; 292/DIG. 65; 292/251.5

(58) Field of Search ..... 292/144, 216, 292/336.3, 347, DIG. 22, DIG. 65, 251.5; 180/281; 70/288, 278.7

(56) References Cited

U.S. PATENT DOCUMENTS

| | | | | |
|---|---|---|---|---|
| 2,189,748 | * | 2/1940 | Wilson | 180/281 |
| 2,505,401 | * | 4/1950 | Ingres | 180/281 |
| 3,151,698 | | 10/1964 | Pollock . | |
| 3,359,767 | | 12/1967 | Arlauskas et al. . | |
| 3,593,816 | * | 7/1971 | Kazaoka | 180/113 |
| 3,612,207 | | 10/1971 | Cabanes et al. . | |
| 3,719,248 | | 3/1973 | Breitschwerdt et al. . | |
| 3,830,332 | | 8/1974 | Fontaine . | |
| 3,871,474 | | 3/1975 | Tomlinson et al. . | |
| 3,990,531 | | 11/1976 | Register . | |
| 4,200,167 | * | 4/1980 | Cockman | 180/281 |
| 4,422,522 | | 12/1983 | Slavin et al. . | |
| 5,069,493 | * | 12/1991 | Mochida | 292/336.3 |
| 5,167,296 | * | 12/1992 | Schreier | 180/281 |
| 5,431,462 | | 7/1995 | Lignell . | |
| 5,560,659 | | 10/1996 | Dault . | |
| 5,669,642 | | 9/1997 | Kang . | |
| 5,715,712 | * | 2/1998 | West | 70/257 |
| 5,743,575 | | 4/1998 | McFarland . | |
| 5,769,471 | | 6/1998 | Suzuki et al. . | |
| 5,894,906 | * | 4/1999 | Weber | 180/274 |

* cited by examiner

*Primary Examiner*—Gary W. Estremsky
(74) *Attorney, Agent, or Firm*—Young & Basile, P.C.

(57) ABSTRACT

A door handle assembly for a motor vehicle which acts to preclude inadvertent unlatching of the door in response to a side impact. The door handle assembly includes a housing and a handle member mounted for pivotal movement on the housing between latched and unlatched positions. An electromagnetic device is mounted on the housing and acts upon energization in response to receipt of an impact signal to preclude movement of the handle to its unlatched position. In one embodiment, the electromagnetic device comprises a solenoid having a plunger which lockingly coacts with detent structure on an arm of the handle in response to a sensed impact. In a second embodiment, the electromagnetic device comprises an electromagnet having a core which coacts upon energization with an armature carried by an arm of the handle to create a magnetic flux force field to preclude handle movement.

14 Claims, 4 Drawing Sheets

74
72
45
10
90
92
80
88
88
34
30
26a
86
94
82
26c
26

46
30e
45
45a
45d
72
45e
74
34f
34b
30f
45b
45e

MOTOR VEHICLE DOOR HANDLE ASSEMBLY

BACKGROUND OF THE INVENTION

This invention relates to door handle assemblies and, more particularly, to door handle assemblies for controlling the latch mechanism on vehicle doors.

Vehicle doors typically include a latch mechanism for latching and unlatching the door to the vehicle body, a handle assembly positioned on the door and operative to control the latch mechanism, and a lock mechanism to selectively render the handle assembly effective or ineffective to operate the latch. It is imperative that side impact against the vehicle, resulting for example from a collision, not result in the inadvertent movement of the handle of the handle assembly to a latch release position with consequent movement of the latch to an unlatched position and consequent inadvertent opening of the door. This in general is not a problem when the door is locked since in this case the door handle is either precluded from movement by the lock mechanism or the door handle is allowed to freewheel to its unlatched position but this movement is ineffective to move the latch to its unlatched position. However, when the door is unlocked, as is most typically the case in a moving vehicle, side impact can easily result in inertial movement of the door handle to its unlatched position with consequent unlatching of the latch mechanism, consequent opening of the door, and consequent discharge of unbuckled vehicle passengers from the vehicle.

Various attempts have heretofore been made to address the side impact problem and specifically to avoid inadvertent opening of the vehicle door in a side impact situation. In the most commonly employed arrangement, a heavy duty spring is employed in association with the door handle. The spring may be sized, for example, to preclude movement of the door handle to its open position in crash situations involving up to 30 G's of impact force. Whereas this arrangement satisfies the existing Federal motor vehicle safety standards with respect to side impact, it also results in a door handle that is very difficult to open because of the heavy duty spring employed in association with the door handle. This arrangement has the further disadvantage that the magnitude of the side impact force that the door handle assembly can withstand without inadvertent opening of the door is limited by the strength of the spring associated with the door handle so that, for example, if the door handle spring is sized to resist a 30 G impact force, any side impact force in excess of 30 G will result in opening of the door.

Various other arrangements have been proposed wherein inertial movement of a component of the door handle assembly upon impact has the effect of blocking the opening or unlatching movement of the door handle assembly. However, these inertial devices are complicated and expensive in construction, and require close manufacturing tolerances to ensure successful, consistent operation.

SUMMARY OF THE INVENTION

This invention is directed to the provision of an improved door handle assembly for use with a vehicular door.

More specifically, this invention is directed to the provision of a vehicle door handle assembly that operates to preclude inadvertent opening of the door in the event of a side impact against the vehicle.

Yet more specifically, this invention is directed to a vehicle door handle assembly employing electromagnetic means to preclude inadvertent opening of the door in a collision scenario.

The invention is intended for use with a motor vehicle assembly comprising a door handle assembly for mounting on a door of the vehicle and moveable between latched and unlatched positions; a latch assembly moveable between latched and unlatched positions to releasably secure the door to a vehicle body structure; means operative in response to movement of the handle assembly from its latched to its unlatched position to move the latch member from its latched to its unlatched position whereby to release the door from the vehicle body and allow opening movement of the door; and means operative in response to a vehicle impact to instantaneously preclude movement of the handle to its unlatched position and thereby preclude inadvertent opening of the door in an accident scenario.

According to the invention, the precluding means comprises an electrical circuit, an impact sensor operative to make or break the electrical circuit in response to a sensed vehicle impact, and an electromagnetic device in the vehicle circuit operative in response to making or breaking of the circuit to preclude movement of a door handle assembly to its unlatched position. This arrangement provides an inexpensive and positive preclusion of inadvertent door handle unlatching movement in a collision scenario.

According to further feature of the invention, the electromagnetic device forms a part of the door handle assembly. This arrangement enables the provision of an inexpensive, compact blocking mechanism and greatly facilitates quality control.

According to further feature of the invention, the door handle assembly includes a handle and a housing mounting the handle for pivotal movement between latched and unlatched positions and the electromagnetic device is mounted on the housing and precludes pivotal movement of the handle on the housing to its unlatched position. This specific handle assembly construction provides a simple, effective, and compact arrangement for precluding inadvertent handle opening movement.

According to further feature of the invention, the handle includes a main body actuator portion for grasping by an operator and arm portion extending from the actuator portion and passing rearwardly through an aperture in the housing to position a section of the arm portion rearwardly of the housing, and the electromagnetic device is mounted on a rear face of the housing proximate the arm portion section. This arrangement provides a compact and inexpensive package suitable for placement within the narrow confines of a motor vehicle.

In one embodiment of the invention, the electromagnetic device comprises a solenoid having a plunger movable to a position blocking movement of the handle to its unlatched position. This element is preferably a push solenoid wherein the plunger is normally spring biased to a retracted position and moves to an extended blocking position in response to energization of the solenoid.

In a further embodiment of the invention, the electromagnetic device comprises an electromagnet secured to a rear face of the housing and coacting with an armature carried by the arm portion section of the handle.

Other objects, advantages and applications of the present invention will become apparent to those skilled in the art when the following description of the best modes contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
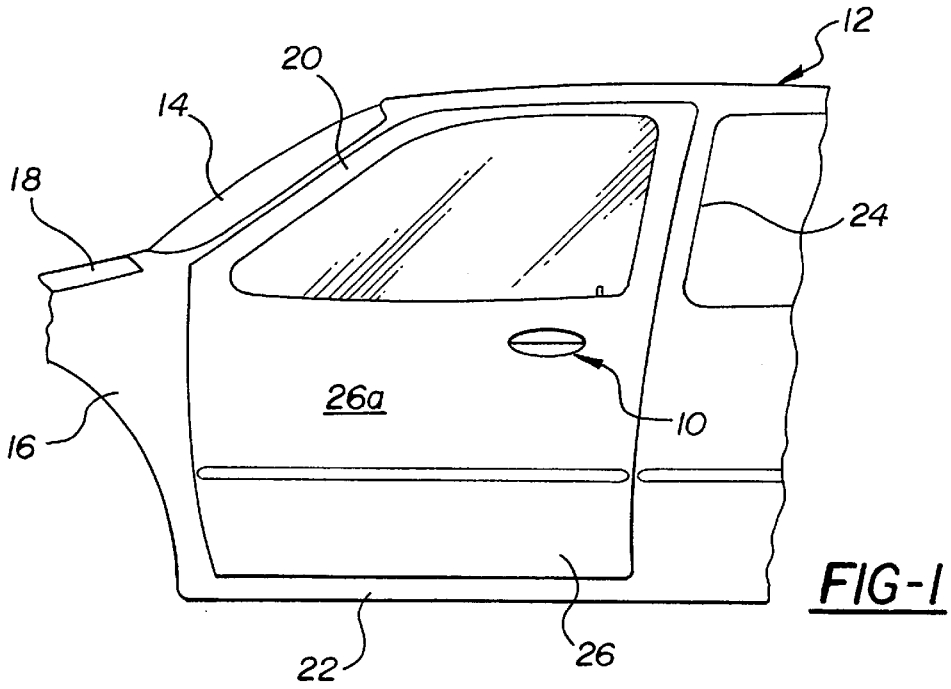
FIG. 1 is a fragmentary view of a vehicle embodying a door handle assembly according to the invention.

The invention door handle assembly 10 is seen in FIG. 1 in association with a fragmentarily shown motor vehicle 12, including a windshield 14, a front quarter panel 16, a hood 18, an A pillar 20, a sill 22, a B pillar 24, and a door 26 positioned in the door opening defined by A pillar 20, front quarter panel 16, sill 22 and B pillar 24 and including an outer skin 26*a*.

Door handle assembly 10, broadly considered, includes an escutcheon or housing 30, a fastener assembly 32, a handle 34, a clip or clamp 36, and an electromagnetic device 37.

Escutcheon 30 is preferably formed as a molded plastic part and includes a main body bowl portion 30*a*, a flange portion 30*b* extending around the entire periphery of bowl portion 30*a*, a platform portion 30*c* extending rearwardly from the rear face 30*d* of main body bowl portion 30*a*;

and a pair of laterally spaced lugs 30*d*, 30*e* extending upwardly and rearwardly from the rear face of main body portion 30*a*.

Threaded fastener assembly 32 comprises a bolt 38, a nut assembly 40 including a nut 40*a* and washer 40*b* peened to the nut, and a circlet lock 42. The head 38*a* of bolt 38 is positioned in a recess 30*e* in the front face of escutcheon platform portion 30*c* and extends rearwardly through an aperture 30*f* in the platform portion to position the threaded shaft 38*b* of the bolt in a rearwardly extending position relative to the rear face 30*g* of platform portion 30*c*. Circlet lock 42 is positioned lockingly over threaded shaft 38*b* and against rear platform face 30*g* to lock the bolt in position relative to the escutcheon.

Handle 34 is preferably formed as a molded plastic part and includes an elongated main body actuator portion 34*a*, an arm or lug 34*b* extending upwardly and rearwardly from main body portion 34*a* and including a hook portion 34*c* at the free end of the lug, and an arm or lug 34*d* extending upwardly and rearwardly from main body portion 34*a* in laterally spaced relation to lug 34*b* and having a crank arm configuration including a crank arm portion 34*e*.

Clip or clamp 36 is preferably formed as a spring steel sheet metal stamping and has a generally U-shaped configuration in cross section including a bight portion 36*a* with an aperture 36*b*; an upper leg portion 36*c* defining a clamping free edge flange 36*d*; and a lower leg portion 38*e* defining a clamping free edge flange 36*f* and dimples 36*g*. Upper and lower leg portions 36*c*, 36*e* extend forwardly from opposite upper and lower edges of bight portion 36*a* in outwardly splayed, outwardly diverging disposition relative to each other. A resilient cushion member 44, formed of a suitable foam material or the like, is adhesively secured to the front or under face of clip upper leg portion 36*c* and extends the full width of the upper leg portion. Aperture 36*b* in clip bight portion 36*a* is oversized with respect to the threaded shaft 38*b* of bolt 38.

Figure 2:
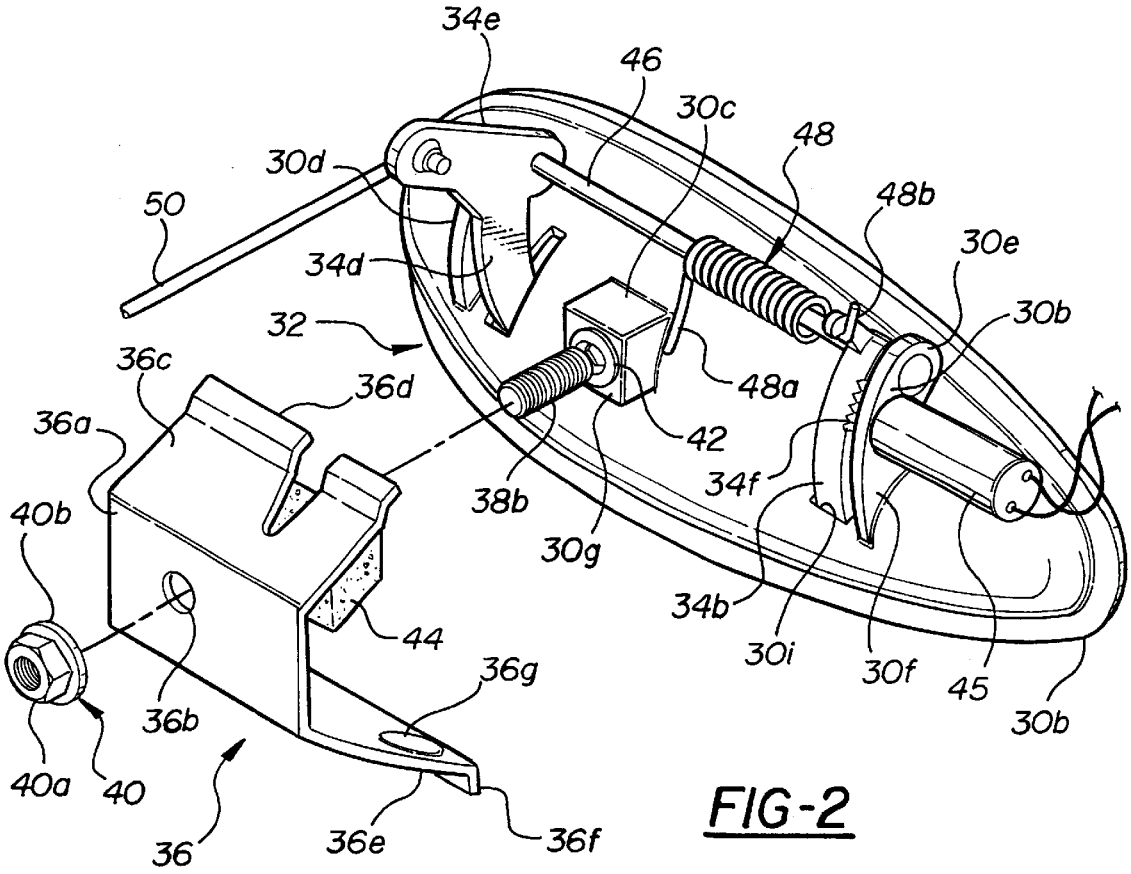
FIG. 2 is a perspective exploded view of the invention door handle assembly.
Figure 7:
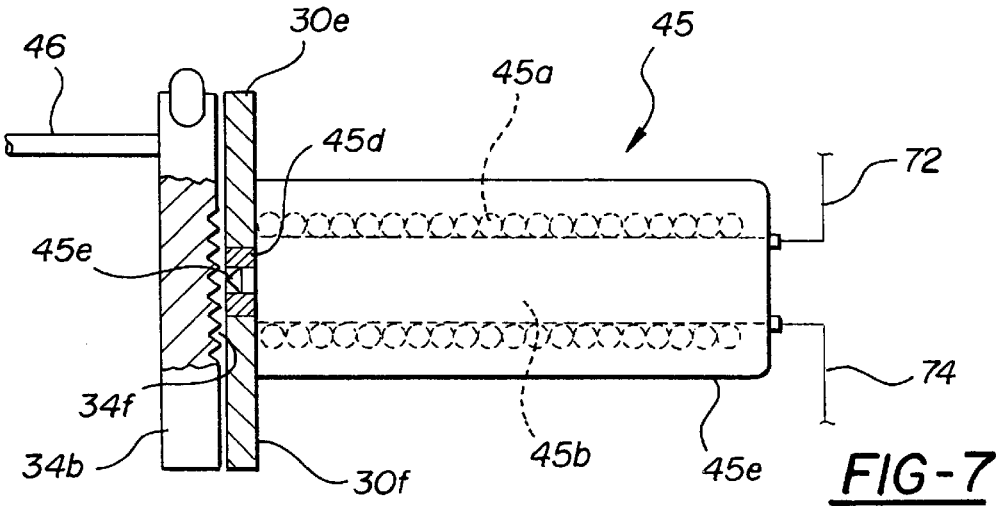
FIGS. 7 and 8 are detail views of a solenoid device utilized in the door handle assembly.
Figure 8:
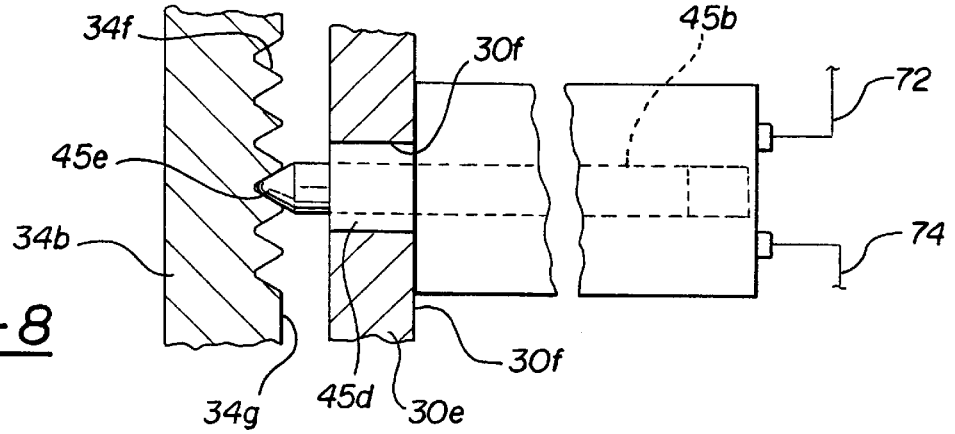

Electromagnetic device 37 comprises a solenoid 45 (FIGS. 2, 7 and 8). Solenoid 45 is of the push type including a coil 45*a* and a plunger 45*b* normally held in a retracted position within the housing 45*c* of the solenoid by spring means (not shown). It will be understood that energization of coil 45*a* has the effect of moving plunger 45*b* to an extended position relative to housing 45*c* and coil 45*a*.

Figure 5:
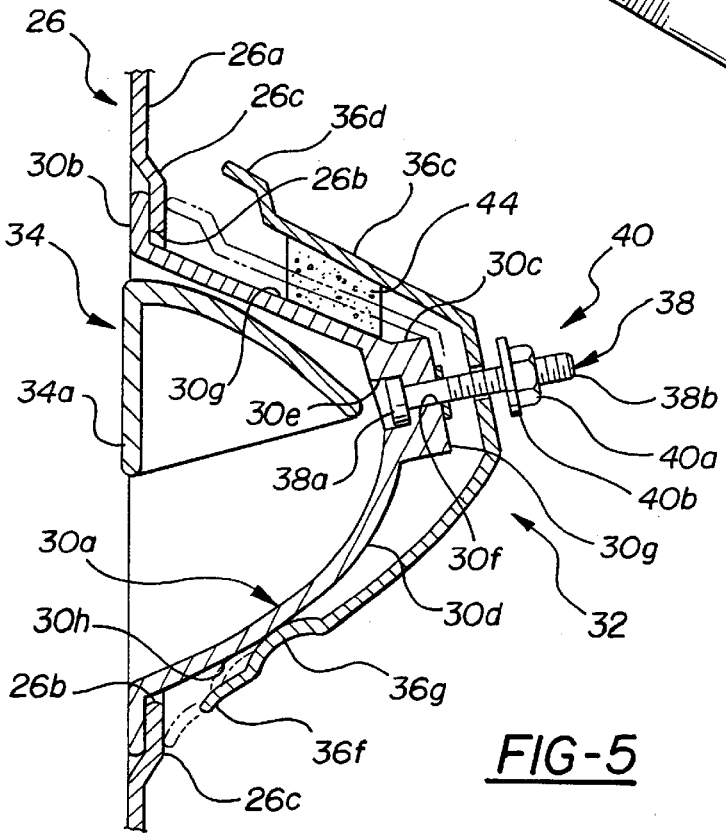
FIG. 5 illustrates the door handle assembly installed in the vehicle door.
Figure 9:
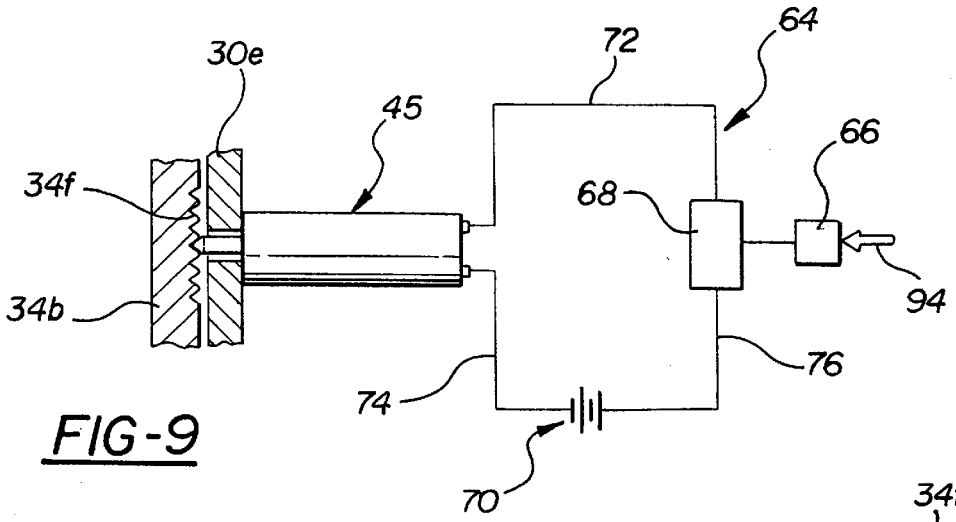
FIG. 9 is a circuit diagram illustrating electrical aspects of the invention door handle assembly.

In the assembled relation of the handle assemble, aperture 36*b* of clip bight portion 36a is positioned over the threaded shaft portion 38*b* of bolt 38 with upper and lower clip legs 36*c* and 36*e* extending forwardly from upper and lower edges of the bight portion in diverging outwardly splayed directions in embracing relation to the main body portion 30*a* of the escutcheon; nut 40*a* is threaded onto the shaft 38*b* to position the nut washer 40*b* proximate clip bight portion 36*a*; cushion member 44 is positioned between clip upper leg portion 36*c* and the confronting surface 30*g* of escutcheon 30 in generally relaxed or uncompressed condition; dimples 36*g* are positioned slidably against the adjacent outer surface 30*h* of escutcheon main body portion 30*a* to provide a sliding relationship between the lower leg portion 36*e* and the escutcheon; handle 34 is positioned within the upper region of the bowl shaped main body portion 30*a* of the escutcheon with lugs 34*b* and 34*d* extending rearwardly through notches or slots 30*i* in the escutcheon; the upper ends of lugs 34*b*, 34*d* are fixedly secured to a pivot pin 46 positioned between laterally spaced escutcheon lugs 30*d*, 30*e*; a coil spring 48 is positioned around pivot pin 46 with one end 48*a* of the spring positioned in a slot 36*h* in the upper leg portion 36*c* of the clip and bearing against the rear face of the escutcheon main body portion 30*a* proximate platform portion 30*c* and the other spring end 48*b* received in the aperture 34*f* defined by lug hook portion 34*c* so as to bias the handle 34 for return movement to the position seen in FIG. 5 in which it is nestled in the upper region of the bowl shaped main body portion 30*a* of the escutcheon; and solenoid 45 is suitably mounted on an outboard face 30*f* of escutcheon lug 30*e* with a solenoid collar or hub 45*d* positioned in an aperture 30*f* in lug 30*e* and plunger 45*b* disposed parallel to the handle pivot axis with its pointed free end 45*e* in confronting relation to a series of serrations 34*f* on the confronting face 34*g* of lug 30*e*. Solenoid 45 is in turn incorporated in a sensor electrical circuit 64 (FIG. 9) including an impact sensor 66, a controller 68, a power source 70, and leads 72, 74, 76 interconnecting the circuit components. Power source 70 may comprise, for example, the vehicle battery. Impact sensor 66 may comprise an existing sensor on the vehicle and may specifically comprise the sensor utilized to actuate the vehicle air bags. Alteratively, sensor 66 may comprise a separate sensor incorporated in a side impact region of the vehicle, for example in the vehicle door. Sensor 66 may comprise an accelerometer and controller 68 may comprise an integrated circuit device of known form operative in response to receipt of an impact signal from sensor 66 to complete circuit 64 to energize solenoid 45 and extend plunger 45*b* outwardly with respect to the body of the solenoid to insert the pointed free end 45*e* of the plunger into aperture 34*f* in handle arm 34*b*.

Figure 4:
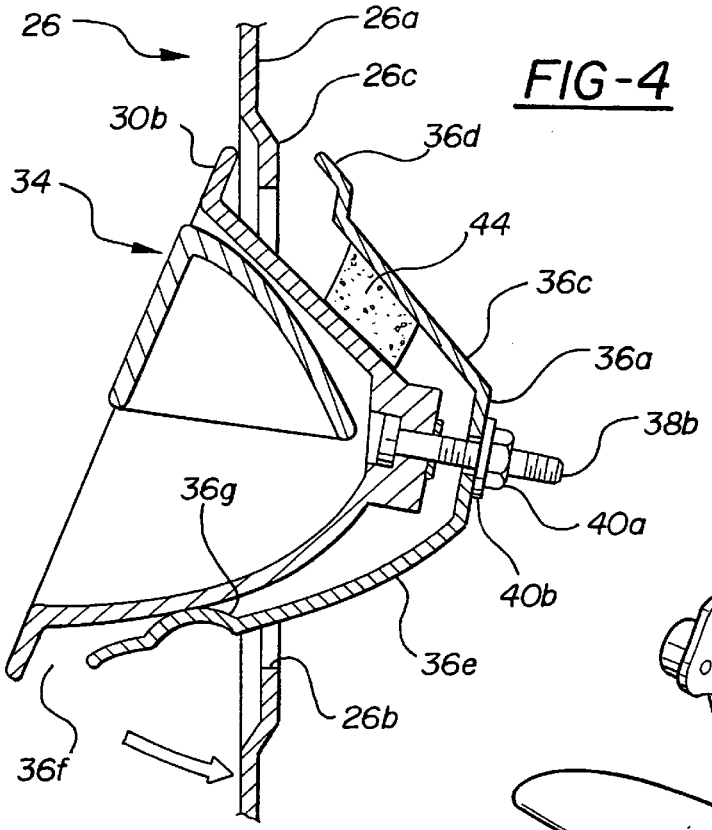
FIG. 4 illustrates the door handle assembly in the process of being installed in a vehicle door.
Figure 3:
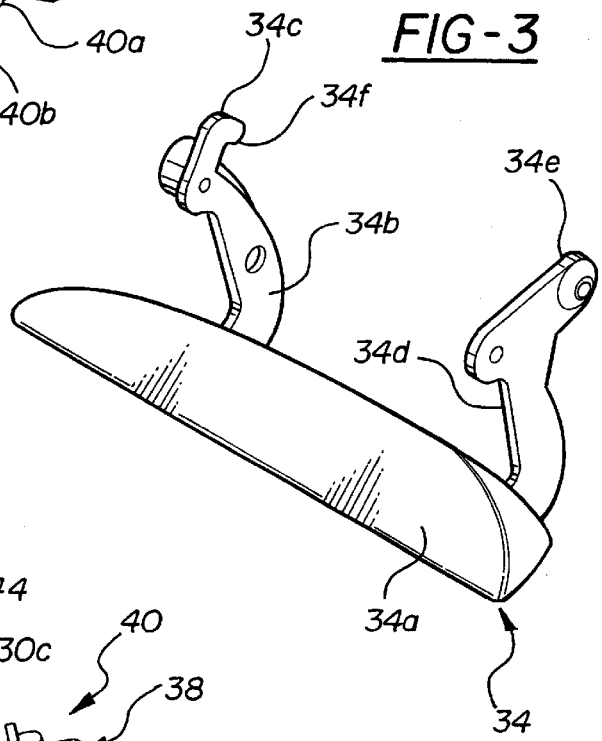
FIG. 3 is a perspective view of a door handle employed in the invention door handle assembly.

To mount handle assembly 10 in door 26, and following the formation in an outer door skin 26*a* of an aperture 26*b* defined by a flange portion 26*c*, the handle assembly is positioned as seen in FIG. 4 with clip edge flange 36*d* on one side of the upper portion of door flange 26*c* and the upper portion of the flange 30*b* of the escutcheon positioned on the other side of the flange 26*c*, whereafter the handle assembly is pivoted downwardly and inwardly about the pivot axis defined between clip portion 36*d* and escutcheon flange portion 30*b* to position the handle assembly in the door aperture 26*b* as seen in FIG. 5. In this position, flange 30*b* seats totally around the outer face of flange 26*c*; cushion member 44 is seated on the upper rear surface 30*g* of the escutcheon; dimples 36*g* are positioned slidably proximate surface 30*h* of the escutcheon; flange edge portion 36*d* of the upper arm portion is positioned proximate but spaced rearwardly from the rear face of the upper portion of door flange 26*c*; and flange edge portion 36*f* of the lower leg portion is positioned proximate but rearwardly of the inner face of the lower portion of door flange 26*c*. These positions are all seen in solid lines in FIG. 5.

After the door handle assembly has been installed in the door to assume the position seen in solid lines in FIG. 5, the installer reaches behind the outer door skin 26*a* and tightens the fastener device 38 and, specifically, turns nut 40 on the threaded shaft 38*b* to move nut washer 40*b* against clip bight portion 36*a*. Thereafter, with continued threaded tightening movement of the nut on the threaded shaft, the clip is moved forwardly with respect to the escutcheon to the dotted line position seen in FIG. 5 where clip flange portions 36*d*, 36*f* clampingly engage respective upper and lower portions of the door flange to fixedly mount the handle assembly in the door.

Figure 6:
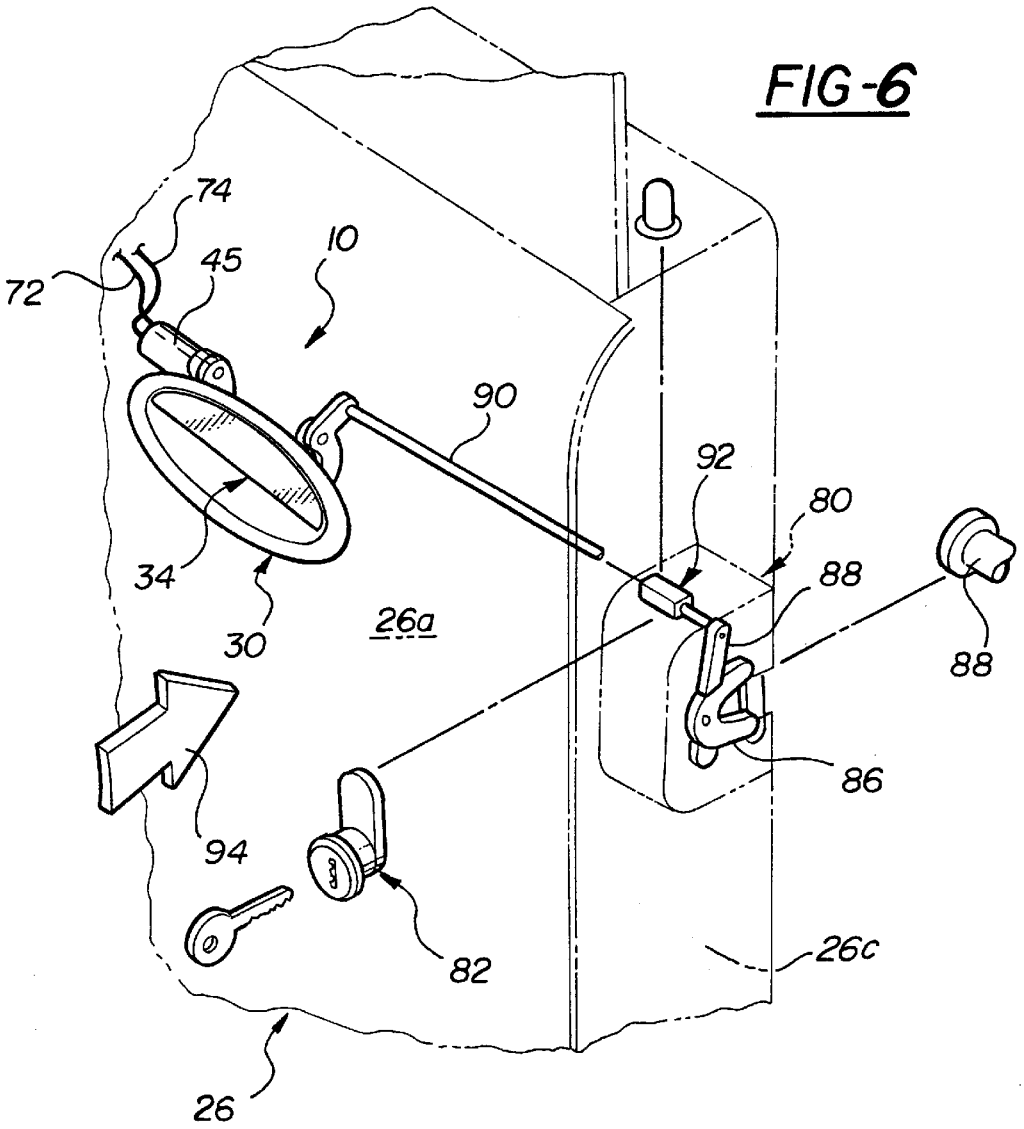
FIG. 6 is a perspective fragmentary somewhat schematic view of the invention door handle assembly incorporated in a vehicle door assembly.

As best seen in FIG. 6, door handle assembly 10 is intended for use with a vehicle door assembly including door 26, a latch assembly 80 positioned on the shut face 26*c* of the door, a key cylinder lock 82 positioned in the outer skin 26*a* of the door proximate door handle assembly 10, and a push button lock 84 positioned on the top sill 26*d* of door 26 in overlying relation to latch assembly 80 and coupled for joint operation with key cylinder lock 82. Latch assembly 80 is of known form and includes a latch member 86 coacting with a bolt 88 on the confronting face of the vehicle body structure to pivotally move the latch member 86 between its illustrated solid line unlatched position and its dotted line latched position. Latch assembly 80 further includes a dog 88 coacting with a detent on latch member 86 to maintain the latch member in its latched condition against the bias of a spring (not shown) and operative when released to allow the latch member to return under the bias of the spring to the unlatched position and thereby move the door to an unlatched position. Dog 88 is controlled in known manner by a link or rod 90 secured to crank arm 30*e*. Specifically, pivotal movement of crank arm 30*e* with key cylinder 82 and push button 84 in unlocked condition has the effect of releasing the latch member 88 for movement to an unlatched position. However, latch assembly 80 in known manner further includes a decoupling mechanism 92 (shown schematically) which serves to render the rod 90 ineffective to release the latch member 86 when the push button 84 and lock cylinder 82 are in a locked condition.

Pivotal movement of the handle from its latched to its unlatched position will of course have no effect on the latching member 86 if the lock mechanisms 82/84 are in a locked condition since in this situation decoupler 92 will act to decouple any movement of the rod 90 from the dog 88 and result in the handle simply free wheeling with no consequent unlatching of the door. However, the most typical operating mode of a moving vehicle involves unlocked doors and, in this most common scenario, side impact, if not guarded against in a manner such as in accordance with the present invention, can readily result in inertial movement of the handle to an unlatched position with consequent unlatching of the door. This inadvertent unlatching movement of the handle, and consequent unlatching of the door, is effectively averted in the door handle assembly of the present invention by utilization of solenoid 45 to block opening movement of the handle.

Specifically, when a side impact 94 is sensed by sensor 66, controller 68 operates to complete circuit 64 to energize solenoid 45 to move solenoid plunger 45*b* outwardly to an extended position in which plunger free end 45*e* is inserted into a serration 34*f* in the arm of the handle to preclude opening movement of the handle in response to the impact. It will be understood that the impact signal generated by sensor 66 is an instantaneous signal and is terminated immediately upon cessation of the impact force so that plunger 45*b* is almost instantaneously withdrawn from the locking position seen in FIG. 8 to the unlocking position seen in FIG. 7 so that the door may thereafter be readily and normally opened by actuation of the handle.

Figure 10:
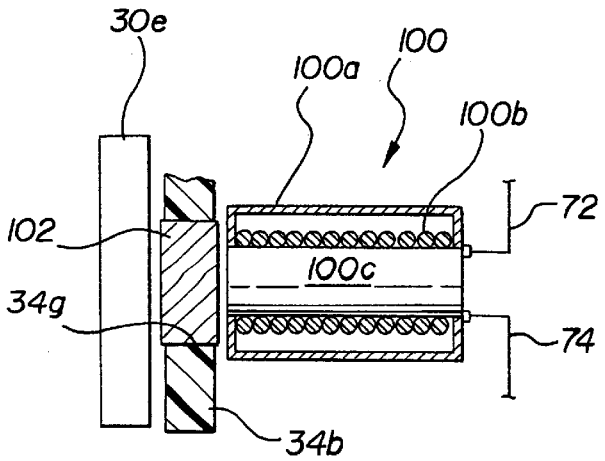
FIGS. 10 and 11 are detail views of an alternate embodiment of the invention.
Figure 11:
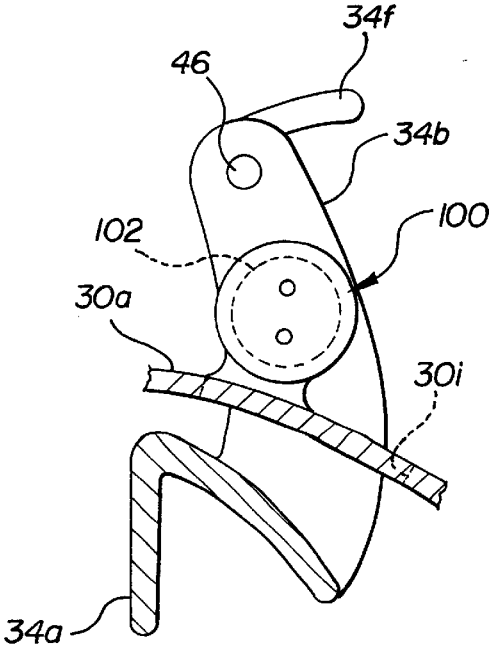

In the alternate embodiment of the invention seen in FIGS. 10 and 11, the electromagnetic device comprises an electromagnet 100, including a housing 100*a*, a coil 100*b*, and a fixed core 100*c*. The core 100*c* of the electromagnet cooperates with an armature 102 positioned in an aperture 34*g* in handle arm 34*b* to preclude opening movement of the handle in response to completion of circuit 64 upon the sensing of an impact 94. Specifically, as electromagnet 100 is energized in response to a sensed impact, a magnetic flux force field is generated at the interface of core 100*c* and armature 102 to preclude movement of handle arm 34*b*, and thereby the handle, to an unlatched position. As with the solenoid embodiment, the energization of the electromagnet is instantaneous and ceases as soon as the impact force is terminated so that the vehicle door may thereafter be opened in the usual manner.

The invention door handle assembly will be seen to provide an effective means of precluding inadvertent unlatching of a vehicle door latch mechanism in the event of side impact. Specifically, the preclusion arrangement of the invention is simple and inexpensive, lends itself to factory quality control standards, presents a compact package that is ideal for positioning in the close confines of a vehicle door, and is positive and reliable in operation.

Whereas preferred embodiments of the invention have been illustrated and described in detail, it will be apparent that various changes may be made in disclosed embodiment without departing from the scope or spirit of the invention.

What is claimed is:

1. A motor vehicle assembly including a door handle assembly for mounting on a door of the vehicle and movable between latched and unlatched handle positions, a latch assembly movable between latched and unlatched positions to releasably secure the door to a vehicle body structure, the latch assembly moveable in response to movement of the handle assembly from the latched handle position to the unlatched handle position to move the latch member from the latched position to the unlatched position to release the door from the vehicle body and allow opening movement of the door, and an electrical circuit operative to preclude inadvertent opening of the door, characterized in that:

the electrical circuit includes an impact sensor operative to make or break the electrical circuit in response to a sensed vehicle impact, and an electromagnetic device operative in response to the impact sensor making or breaking the circuit to preclude movement of the door handle assembly to the unlatched handle position in the event of a sensed vehicle impact.

2. A motor vehicle assembly according to claim 1 wherein the electromagnet device forms a part of the door handle assembly.

3. A motor vehicle assembly according to claim 2 wherein:

the door handle assembly includes a handle and a housing mounting the handle for movement between latched and unlatched positions; and the electromagnetic device is mounted on the housing and precludes movement of the handle on the housing to its unlatched position.

4. A motor vehicle assembly according to claim 3 wherein the electromagnetic device comprises a solenoid having a plunger movable to a position blocking movement of the handle to its unlatched position.

5. A motor vehicle assembly according to claim 4 wherein the plunger coacts with a detent structure on the door handle.

6. A motor vehicle assembly according to claim 4 wherein the solenoid is a push solenoid and wherein the plunger is normally spring biased to a retracted position and moves to an extended blocking position in response to energization of the solenoid.

7. A motor vehicle assembly according to claim 3 wherein the electromagnetic device comprises an electromagnet secured to the housing and coacting with an armature member carried by the handle.

8. A door handle assembly for use with a motor vehicle including a door, a latch assembly mounted on the door, the door handle assembly adapted to control the latch assembly, and an impact sensor operative to generate an impact signal in response to a sensed vehicle impact, the door handle assembly comprising:

a handle adapted to be mounted on the door for movement between latched and unlatched handle positions;

an electromagnetic device adapted to be mounted on the door in proximity to the door handle and operative when actuated to preclude movement of the handle from the latched handle position to the unlatched handle position; and means, operative in response to receipt of an impact signal from the impact sensor, for actuating the electromagnetic device to preclude movement of the handle from the latched handle position to the unlatched handle position.

9. A door handle assembly according to claim 8 wherein:

the door handle assembly further includes a housing adapted to be mounted in the door;

the handle is mounted on the housing for movement between its latched and unlatched positions; and the electromagnetic device is mounted on the housing.

10. A door handle assembly according to claim 9 wherein the electromagnetic device comprises a solenoid mounted on the housing and having a plunger movable to a position blocking movement of the handle to its unlatched position.

11. A door handle assembly according to claim 10 wherein he plunger coacts with a detent structure on the door handle.

12. A door handle assembly according to claim 9 wherein:

the handle includes a main body actuator portion for grasping by an operator and an arm portion extending from the actuator portion and passing rearwardly through an aperture in the housing to position a section of the arm portion rearwardly of the housing; and the electromagnetic device is mounted on a rear face of the housing proximate the arm portion section.

13. A door handle assembly according to claim 12 wherein:

the housing includes a main body portion, adapted to be positioned in an opening in the vehicle door and pivotally mounting the handle, and a lug portion extending rearwardly from the main body portion;

the arm portion section of the handle is positioned proximate the lug portion of the housing; and the solenoid is mounted on the lug portion with its plunger extending through the lug portion for coaction with detent structure on the arm portion section.

14. A door handle assembly for use with a motor vehicle including a door and a latch assembly mountable on the door and controlled by the door handle assembly, the door handle assembly comprising:

a housing adapted to be mounted in the door;

a handle mounted on the housing for movement between latched and unlatched handle positions; and an electromagnetic device adapted to be mounted on the door in proximity to the door handle and operative when actuated to preclude movement of the handle from the latched handle position to the unlatched handle position, the electromagnetic device including an electromagnet mounted on the housing and coacting with an armature carried by the handle.

* * * * *